US005645514A

United States Patent [19]

Chen

[11] Patent Number: 5,645,514

[45] Date of Patent: Jul. 8, 1997

[54] PULLING TYPE EXERCISER

[76] Inventor: Paul Chen, 5F., No. 31, Gan Tzou 2nd Street, Shi Tun Chu, Taichung, Taiwan

[21] Appl. No.: 716,894

[22] Filed: Sep. 20, 1996

[51] Int. Cl.[6] ..... A63B 21/00; A63B 21/02

[52] U.S. Cl. ..... 482/72; 482/123; 482/129

[58] Field of Search ..... 482/72, 73, 123, 482/125, 129, 130

[56] References Cited

U.S. PATENT DOCUMENTS 4,647,035 3/1987 Yellen ..... 482/72
5,108,090 4/1992 Reed ..... 482/72

FOREIGN PATENT DOCUMENTS 376851 7/1932 United Kingdom ..... 482/72
2137104 10/1984 United Kingdom ..... 482/73

*Primary Examiner*—Richard J. Apley
*Assistant Examiner*—Denise Pothier
*Attorney, Agent, or Firm*—Charles E. Baxley, Esq.

[57] ABSTRACT

An exerciser includes a base tube and an extension slidably engaged in the base tube. The extension includes a front end movable outward of the base tube. A frame is secured to the front end of the extension for supporting a shaft and a pulley. One or more wheels are secured on the shaft for facilitating the movement of the extension relative to the base tube. A resilient band is received in the base tube and the extension and has a front end engaged over the pulley. A handle is secured to the front end of the resilient band for exercising the upper muscle.

3 Claims, 4 Drawing Sheets

PULLING TYPE EXERCISER

BACKGROUND OF THE INVENTION

1. Field of the Invention

The present invention relates to an exerciser, and more particularly to an exerciser for conducting pulling and stepping exercises.

2. Description of the Prior Art

The inventor has developed a series of horse riding simulating exercisers. However, the exercisers normally include a large volume such that some of the families may not use the exercisers.

The present invention has arisen to mitigate and/or obviate the afore-described disadvantages of the conventional exercisers.

SUMMARY OF THE INVENTION

The primary objective of the present invention is to provide an exerciser including a compact configuration for allowing the exerciser to be easily used in most of the families.

In accordance with one aspect of the invention, there is provided an exerciser comprising a base tube, an extension slidably engaged in the base tube, the extension including a front end movable outward of the base tube, a frame secured to the front end of the extension and moved in concert with the extension, a shaft secured on the frame for moving the extension outward of the base tube, at least one wheel secured on the shaft for facilitating movement of the extension, and means for biasing the extension inward of the base tube.

The frame further includes a pulley provided therein, the biasing means includes a resilient band received in the base tube and the extension, the resilient band includes a rear end secured to the base tube and includes a front end engaged over the pulley, the exerciser further includes a handle secured to the front end of the resilient band.

The base tube includes a bottom portion having at least one plate secured thereon for stably supporting the base tube on a supporting surface.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
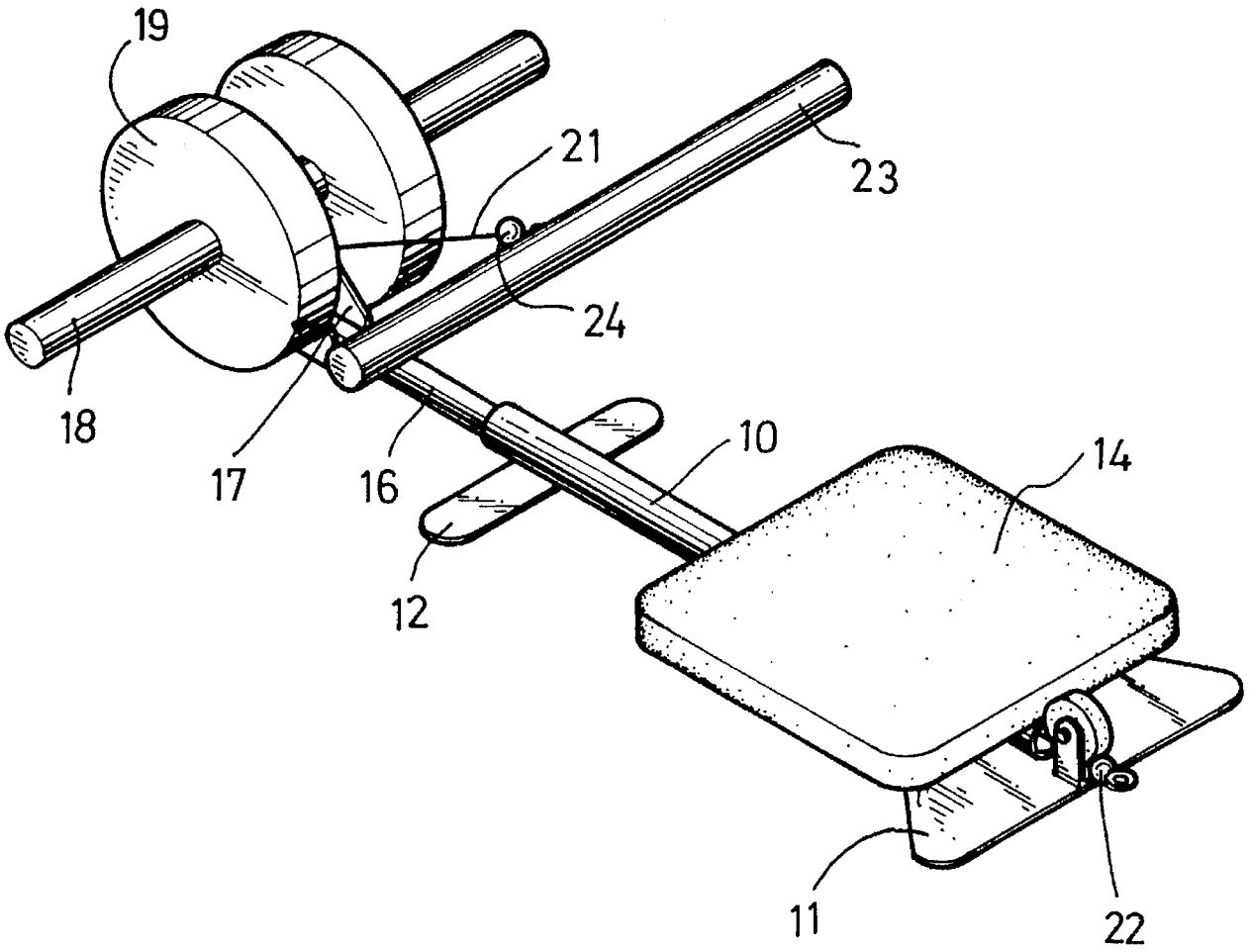
FIG. 1 is a perspective view of an exerciser in accordance with the present invention.
Figure 2:
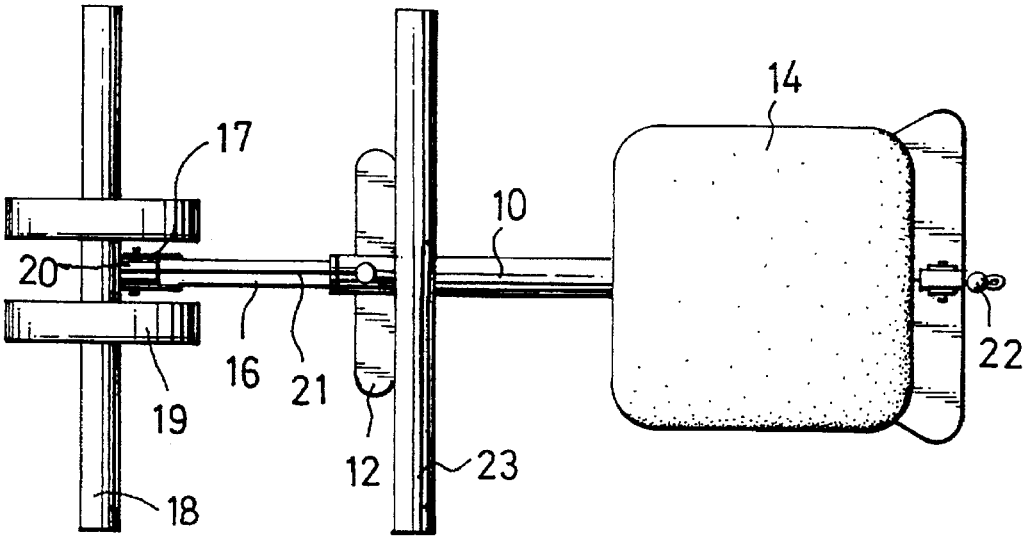
FIG. 2 is a top plane view of the exerciser.
Figure 3:
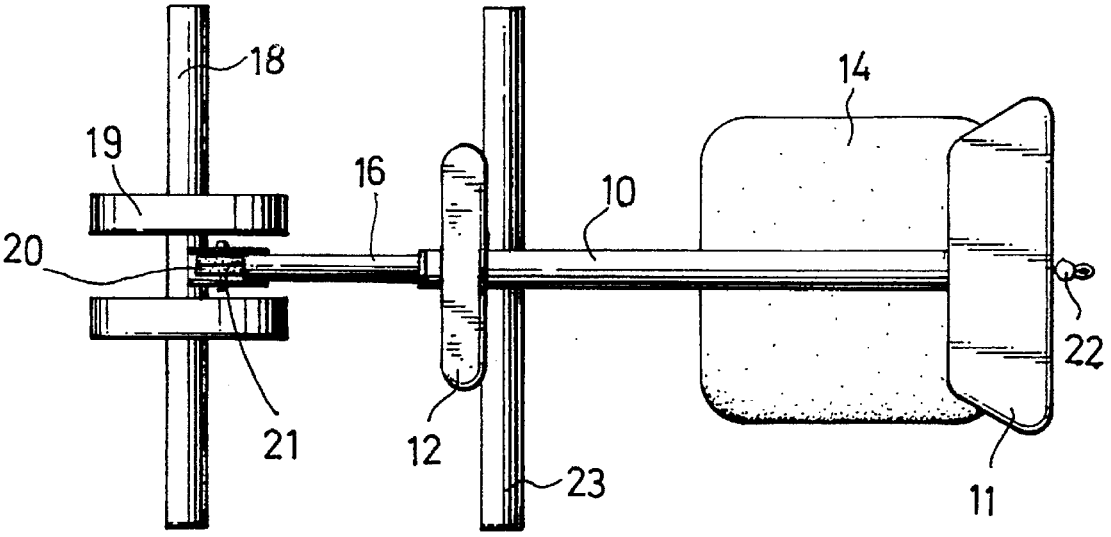
FIG. 3 is a bottom plane view of the exerciser.
Figure 4:
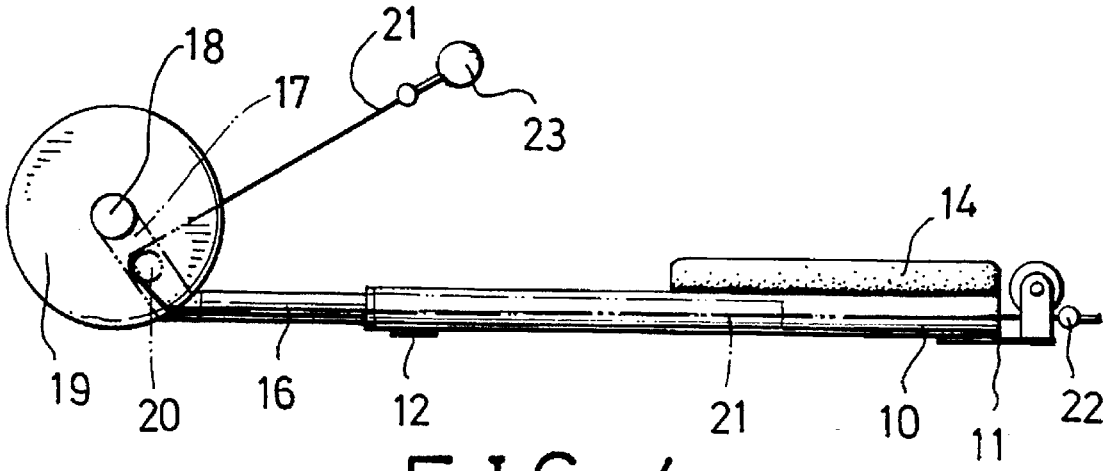
FIG. 4 is a side view of the exerciser.
Figure 5:
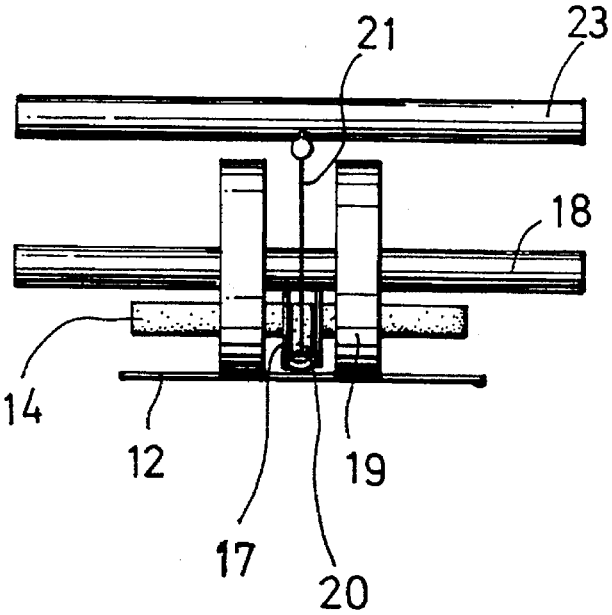
FIG. 5 is a front view of the exerciser.
Figure 6:
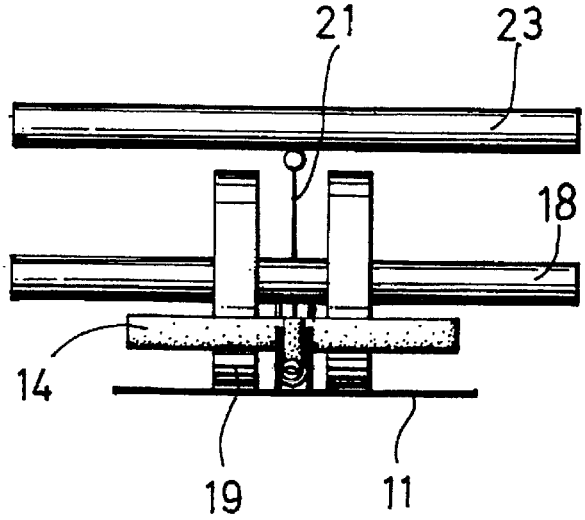
FIG. 6 is a rear view of the exerciser.

Referring to the drawings, and initially to FIGS. 1 to 6, an exerciser in accordance with the present invention comprises a base tube 10 having one or more panels 11, 12 secured to the bottom of the base tube 10 for stably supporting the base tube 10 on the ground surface. A seat cushion 14 is secured on the base tube 10 for supporting a user. An extension 16 is slidably engaged in the tube 10 and includes a front end extended outward of the tube 10. A frame 17 is secured on the front end of the extension 16 and moved in concert with the extension 16. A shaft 18 is secured on the frame 17 for rotatably supporting one or more wheels 19 thereon and for allowing the extension 16 to be easily moved outward of the tube 10. A pulley 20 is rotatably supported in the frame 17. A resilient band 21 is received in the tube 10 and the extension 16 and includes a stop 22 secured to the rear end for positioning purposes and includes a front portion engaged around the pulley 20 and secured to a handle 23.

Figure 7:
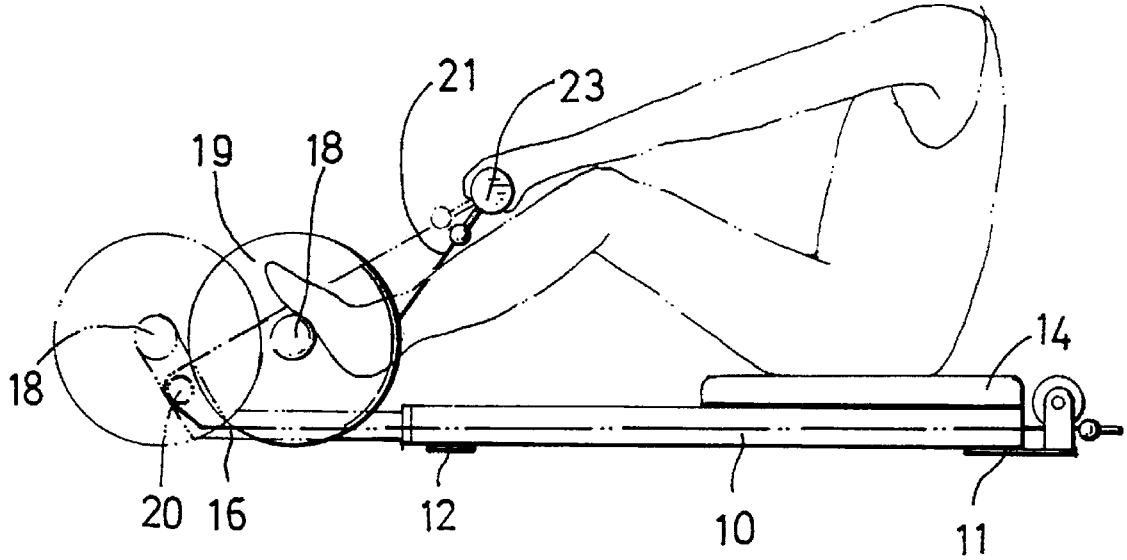
FIGS. 7 and 8 are side views illustrating the operation of the exerciser.
Figure 8:
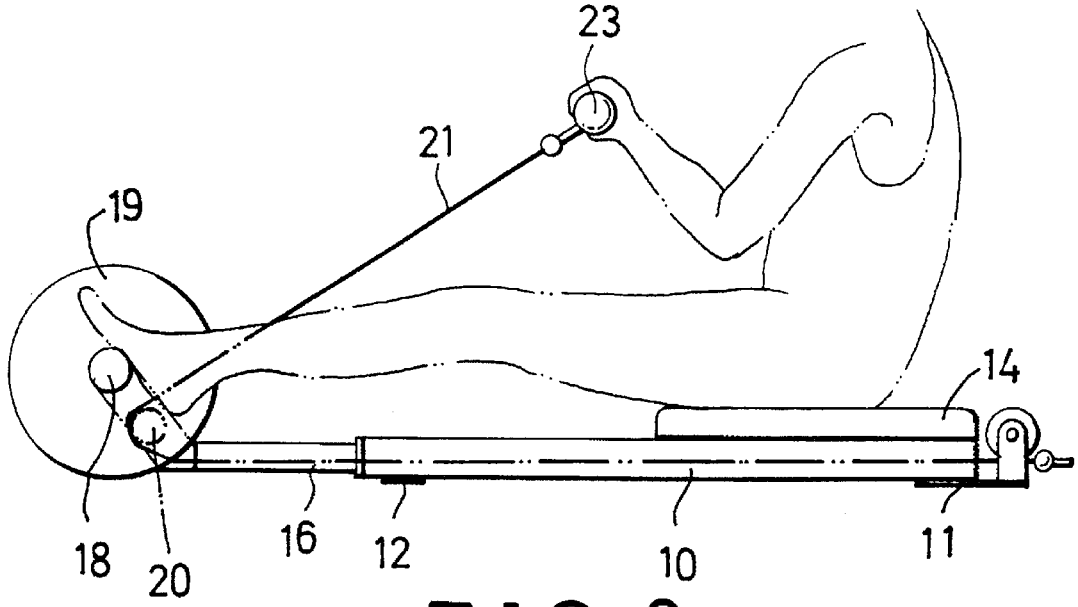

In operation, as shown in FIGS. 7 and 8, the shaft 18 may be moved forward against the spring force of the resilient band 21 by the feet of the user in order to exercise the lower muscle of the user. Simultaneously, the handle 23 may also be pulled toward the user against the spring force of the resilient band 21 by the hands of the user in order to exercise the upper muscle of the user. The handle 23 may be pulled to the rear portion of the seat cushion 14 and secured to the stop 22; or, the handle 23 may be disengaged from the resilient band 21 and another stop 24 may be secured to the band 21 for positioning the front end of the resilient band 21. At this moment, the user may knee on the seat cushion 14 and may grip the shaft 18 for moving the shaft 18 and the wheels 19 forward and backward for exercising the waist portion of the user.

It is preferable that a pair of foot pedals may be attached to the shaft 18 for supporting the feet of the user. Alternatively, the shaft 18 may be rotatably supported on the frame 17. At this situation, the wheels 19 may he solidly secured to the shaft 18 and rotated in concert with the shaft 18. It is to be noted that the exerciser may be folded to a rather compact configuration which is excellent for transportation and storing purposes. In addition, the exerciser may be widely used for the family having compact space.

Accordingly, the exerciser in accordance with the present invention includes a compact configuration for allowing the exerciser to be easily used in most of the families.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

an elongated base tube, an extension slidably engaged in said elongated base tube along the longitudinal axis thereto, said extension including a front end movable outward of said base tube, a frame secured to said front end of said extension, having a pulley provided therein, and moved in concert with said extension, a shaft secured on said frame for moving said extension outward of said base tube, at least one wheel rotatably secured on said shaft for facilitating movement of said extension, and a means for biasing said extension toward said base tube including a resilient band received in said base tube and said extension, said resilient band includes a rear end secured to said base tube and includes a front end engaged over said pulley.

2. An exerciser according to claim 1, wherein said exerciser further includes a handle secured to said front end of said resilient band.

3. An exerciser according to claim 1, wherein said base tube includes a bottom portion having at least one plate secured thereon for stably supporting said base tube on a supporting surface.

* * * * *